US006769967B1

(12) United States Patent
Southwick

(10) Patent No.: US 6,769,967 B1
(45) Date of Patent: Aug. 3, 2004

(54) APPARATUS AND METHOD FOR REFURBISHING POLISHING PADS USED IN CHEMICAL-MECHANICAL PLANARIZATION OF SEMICONDUCTOR WAFERS

(75) Inventor: Scott A. Southwick, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/578,265

(22) Filed: May 24, 2000

Related U.S. Application Data

(63) Continuation of application No. 09/120,392, filed on Jul. 21, 1998, now abandoned, which is a continuation of application No. 08/735,804, filed on Oct. 21, 1996, now Pat. No. 5,782,675.

(51) Int. Cl.[7] ..... B24B 53/00

(52) U.S. Cl. ..... 451/56; 451/41; 451/54; 451/287; 451/443; 451/444

(58) Field of Search ..... 451/41, 56, 57, 451/54, 285, 287, 288, 289, 443, 444; 15/21.1, 39.5, 88.2, 209.1, 230; 134/34, 93, 172, 192, 902

(56) References Cited

U.S. PATENT DOCUMENTS

| | | | | |
|---|---|---|---|---|
| 3,031,195 A | | 4/1962 | Lundsford | 274/9 |
| 4,438,601 A | | 3/1984 | Olson | 451/444 |
| 4,462,188 A | | 7/1984 | Payne | 451/41 |
| 4,841,684 A | | 6/1989 | Hall, Jr. | 451/532 |
| 5,081,051 A | | 1/1992 | Mattingly et al. | 437/10 |
| 5,154,021 A | | 10/1992 | Bombardier et al. | 51/262 A |
| 5,216,843 A | | 6/1993 | Breivogel et al. | 51/131.1 |
| 5,245,796 A | | 9/1993 | Miller et al. | 451/444 |
| 5,384,986 A | | 1/1995 | Hirose et al. | 451/444 |
| 5,421,768 A | | 6/1995 | Fujiwara et al. | 451/288 |
| 5,456,627 A | | 10/1995 | Jackson et al. | 451/56 |
| 5,522,965 A | | 6/1996 | Chisholm et al. | 156/636.1 |
| 5,536,202 A | | 7/1996 | Appel et al. | 451/285 |
| 5,578,529 A | | 11/1996 | Mullins | 451/41 |
| 5,616,069 A | * | 4/1997 | Walker et al. | 451/56 |
| 5,618,447 A | | 4/1997 | Sandhu | 438/14 |
| 5,624,303 A | | 4/1997 | Robinson | 451/285 |
| 5,628,862 A | | 5/1997 | Yu et al. | 156/345 |
| 5,643,067 A | * | 7/1997 | Katsuoka et al. | 451/56 |
| 5,645,682 A | | 7/1997 | Skrovan | 156/636.1 |
| 5,658,190 A | | 8/1997 | Wright et al. | 451/285 |
| 5,664,990 A | | 9/1997 | Adams et al. | 451/60 |
| 5,957,757 A | * | 9/1999 | Berman | 451/56 |

* cited by examiner

*Primary Examiner*—Eileen P. Morgan
(74) *Attorney, Agent, or Firm*—Dorsey & Whitney, LLP

(57) ABSTRACT

An apparatus and method for refurbishing fixed-abrasive polishing pads. In one embodiment, a refurbishing device has an arm positionable over the planarizing surface of the polishing pad, a refurbishing element attached to one end of the arm, and an actuator connected to the other end of the arm. The refurbishing element has a non-abrasive contact medium engageable with the planarizing surface of the polishing pad that does not abrade or otherwise damage raised features on the fixed-abrasive pad under desired conditioning down forces. The actuator moves the arm downwardly and upwardly with respect to the planarizing surface to engage and disengage the non-abrasive contact medium with the planarizing surface of the polishing pad. The refurbishing device may also have a conditioning solution dispenser positionable proximate to the planarizing surface of the polishing pad to dispense a liquid conditioning solution onto the planarizing surface. The conditioning solution is selected from a liquid that reacts or otherwise interacts with the particular waste matter material to allow the non-abrasive contact medium to remove waste matter material from the polishing pad. As the refurbishing element engages the planarizing surface in the presence of the conditioning solution, at least one of the refurbishing element or the polishing pad moves with respect to the other. In operation, the conditioning solution and the refurbishing element remove waste matter from the pad without abrading or otherwise damaging the planarizing surface of the polishing pad.

36 Claims, 3 Drawing Sheets

APPARATUS AND METHOD FOR REFURBISHING POLISHING PADS USED IN CHEMICAL-MECHANICAL PLANARIZATION OF SEMICONDUCTOR WAFERS

CROSS REFERENCE TO RELATED APPLICATION

This application is a continuation of U.S. patent application Ser. No. 09/120,392, filed Jul. 21, 1998 now abandoned, which is a continuation of U.S. Pat. Ser. No. 5,782,675 issuing from U.S. patent application Ser. No. 08/735,804, filed Oct. 21, 1996.

TECHNICAL FIELD

The present invention relates to an apparatus and a method for refurbishing abrasive polishing pads used in chemical-mechanical planarization of semiconductor wafers.

BACKGROUND OF THE INVENTION

Chemical-mechanical planarization ("CMP") processes remove material from the surface of a semiconductor wafer in the production of integrated circuits. FIG. 1 schematically illustrates a CMP machine 10 with a platen 20, a wafer carrier 30, a polishing pad 40, and a planarizing liquid 44 on the polishing pad 40. The polishing pad 40 may be a conventional polishing pad made from a continuous phase matrix material (e.g., polyurethane), or it may be a new generation fixed-abrasive polishing pad made from abrasive particles fixedly dispersed in a suspension medium. The planarizing liquid 44 may be a conventional CMP slurry with abrasive particles and chemicals that remove material from the wafer, or the planarizing liquid 44 may be a planarizing solution without abrasive particles. In most CMP applications, conventional CMP slurries are used on conventional polishing pads, and planarizing solutions without abrasive particles are used on fixed-abrasive polishing pads.

The CMP machine 10 also has an under-pad 25 attached to an upper surface 22 of the platen 20 and the lower surface of the polishing pad 40. A drive assembly 26 rotates the platen 20 (as indicated by arrow A), or it reciprocates the platen back and forth (as indicated by arrow B). Since the polishing pad 40 is attached to the under-pad 25, the polishing pad 40 moves with the platen 20.

The wafer carrier 30 has a lower surface 32 to which a wafer 12 may be attached, or the wafer 12 may be attached to a resilient pad 34 positioned between the wafer 12 and the lower surface 32. The wafer carrier 30 may be a weighted, free-floating wafer carrier; or an actuator assembly 36 may be attached to the wafer carrier to impart axial and/or rotational motion (as indicated by arrows C and D, respectively).

To planarize the wafer 12 with the CMP machine 10, the wafer carrier 30 presses the wafer 12 face-downward against the polishing pad 40. While the face of the wafer 12 presses against the polishing pad 40, at least one of the platen 20 or the wafer carrier 30 moves relative to the other to move the wafer 12 across the planarizing surface 42. As the face of the wafer 12 moves across the planarizing surface 42, material is continuously removed from the face of the wafer 12.

One problem with CMP processing is that the throughput may drop, and the uniformity of the polished surface on the wafer may be inadequate, because waste particles from the wafer accumulate on the planarizing surface 42 of the polishing pad 40. The problem is particularly acute when planarizing doped silicon oxide layers because doping softens silicon oxide and makes it slightly viscous as it is planarized. As a result, accumulations of doped silicon oxide glaze the planarizing surface of the polishing pad with a coating that substantially reduces the polishing rate over the glazed regions.

To return the polishing pads to an adequate state for planarizing additional wafers, the polishing pads are typically conditioned by removing the accumulations of waste matter with an abrasive disk. Conventional abrasive conditioning disks are generally embedded with diamond particles, and they are mounted to a separate actuator on a CMP machine that sweeps them across the polishing pad. Typical abrasive disk pad conditioners remove a thin layer of the pad material itself in addition to the waste matter to form a new, clean planarizing surface on the polishing pad. Some abrasive disk pad conditioners also use a liquid solution that dissolves some of the waste matter as the abrasive disks abrade the polishing surface.

Although conventional diamond-embedded abrasive disks are well suited to condition conventional polishing pads, they may not be well suited to condition the new generation of fixed-abrasive polishing pads. Fixed-abrasive polishing pads generally have exposed abrasive particles across their planarizing surfaces. Additionally, fixed-abrasive pads may have topographical features across their planarizing surface. When a fixed-abrasive polishing pad is conditioned with a diamond-embedded abrasive disk, the diamonds not only remove waste matter material, but they also remove abrasive particles and may damage other features on the planarizing surface of the polishing pad. Conditioning a fixed-abrasive polishing pad with a diamond-embedded disk will likely alter the planarizing surface, and thus the planarizing properties, of the polishing pad. Therefore, conventional pad conditioning processes do not work with the new generation of fixed-abrasive polishing pads.

SUMMARY OF THE INVENTION

The present invention is an apparatus and method for refurbishing abrasive polishing pads. In one embodiment, the refurbishing device has an arm positionable over the planarizing surface of the polishing pad, a refurbishing element attached to one end of the arm, and an actuator connected to the other end of the arm. The refurbishing element has a non-abrasive contact medium engageable with the planarizing surface of the polishing pad that does not abrade or otherwise damage raised features on the fixed-abrasive pad under desired conditioning down forces. The actuator moves the arm downwardly and upwardly with respect to the planarizing surface to engage and disengage the non-abrasive contact medium with the planarizing surface of the polishing pad. In a preferred embodiment, the refurbishing device also has a conditioning solution dispenser positionable proximate to the planarizing surface of the polishing pad to dispense a liquid conditioning solution onto the planarizing surface. The conditioning solution is selected from a liquid that reacts with the particular waste matter material to allow the non-abrasive contact medium to remove waste matter material from the polishing pad. As the refurbishing element engages the planarizing surface in the presence of the conditioning solution, at least one of the refurbishing element or the polishing pad moves with respect to the other. In operation, the conditioning solution and the refurbishing element remove waste matter from the pad without abrading or otherwise damaging the planarizing surface of the polishing pad.

In a preferred embodiment, a planarizing machine for chemical-mechanical planarization of a semiconductor wafer has a platen mounted to a support structure and a fixed-abrasive polishing pad positioned on the platen. The fixed-abrasive polishing pad has a suspension medium, a plurality of abrasive particles fixedly dispersed in the suspension medium, and a planarizing surface with exposed abrasive particles. The planarizing machine also has a movable wafer carrier adapted to hold the wafer and engage the wafer with the planarizing surface of the polishing pad. At least one of the platen or the wafer carrier moves with respect to the other to impart relative motion between the wafer and the planarizing surface of the polishing pad. In one embodiment, the planarizing machine has a refurbishing element carriage positioned proximate to the polishing pad, a non-abrasive refurbishing element attached to the carriage, and a solution dispenser positioned proximate to the pad. The refurbishing element carriage has an arm positionable over the planarizing surface and an actuator for moving the arm towards or away from the planarizing surface. The non-abrasive refurbishing element is preferably attached to the arm of the carriage.

In operation, the carriage moves the non-abrasive refurbishing element into engagement with the planarizing surface of the polishing pad as at least one of the carriage and the polishing pad moves with respect to the other to impart relative motion therebetween. A conditioning solution selected to dissolve or oxidize the waste matter material is simultaneously deposited onto the polishing pad. The conditioning solution breaks down the waste matter so that the non-abrasive refurbishing element can remove the waste matter material from the polishing pad without damaging the planarizing surface.

In a method of conditioning a fixed-abrasive polishing pad in accordance with the invention, a conditioning solution that dissolves, oxidizes, or otherwise breaks down the waste matter material is deposited onto at least a portion of the planarizing surface of the fixed-abrasive polishing pad. A non-abrasive refurbishing element is pressed against the planarizing surface in the presence of the conditioning solution, and at least one of the fixed-abrasive polishing pad or the non-abrasive refurbishing element is moved with respect to the other to impart relative motion therebetween. As the refurbishing element moves against the planarizing surface, the conditioning solution and the non-abrasive refurbishing element remove the waste matter material from the planarizing surface without eroding the topography of the planarizing surface.

DETAILED DESCRIPTION OF THE INVENTION

The present invention is a pad refurbishing device that removes waste material from fixed-abrasive polishing pads without abrading or otherwise damaging the planarizing surface of the fixed-abrasive pads. An important aspect of an embodiment of the refurbishing device is to provide a conditioning solution that breaks down the waste matter material to a state in which it may be removed with a relatively low mechanical force. Another important aspect of an embodiment of the refurbishing device is to provide a non-abrasive refurbishing element that engages the planarizing surface and removes the waste matter without abrading or otherwise damaging raised features on the polishing pad. FIGS. 2–5B, in which like reference numbers refer to like parts throughout the various figures, illustrate some embodiments of pad refurbishing devices and non-abrasive pad refurbishing elements in accordance with the invention.

Figure 1:
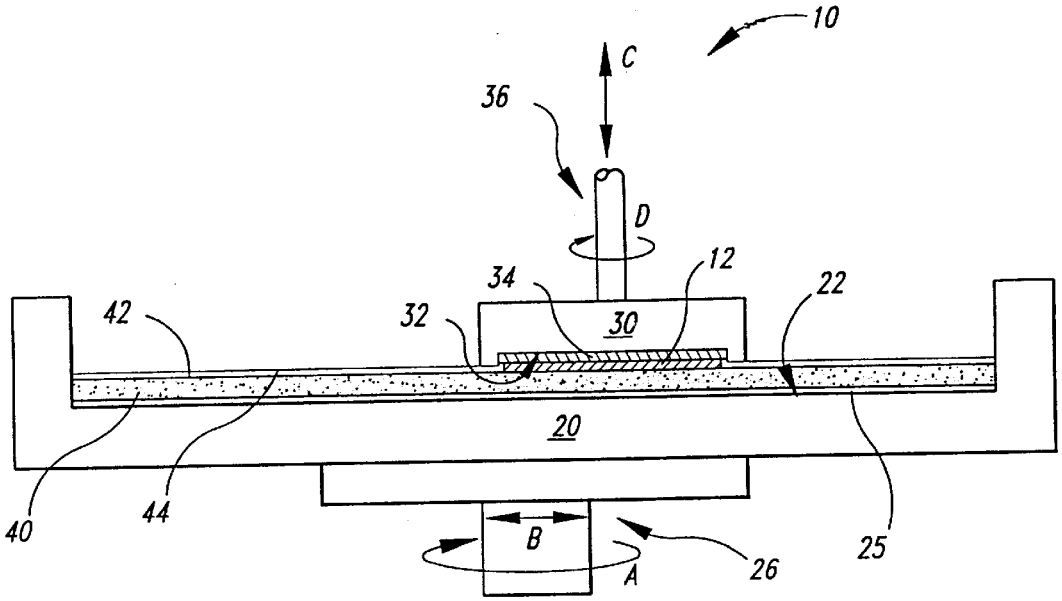
Fig. 1 (PRIOR ART)
FIG. 1 is a schematic view of a chemical-mechanical planarization machine in accordance with the prior art.
Figure 2:
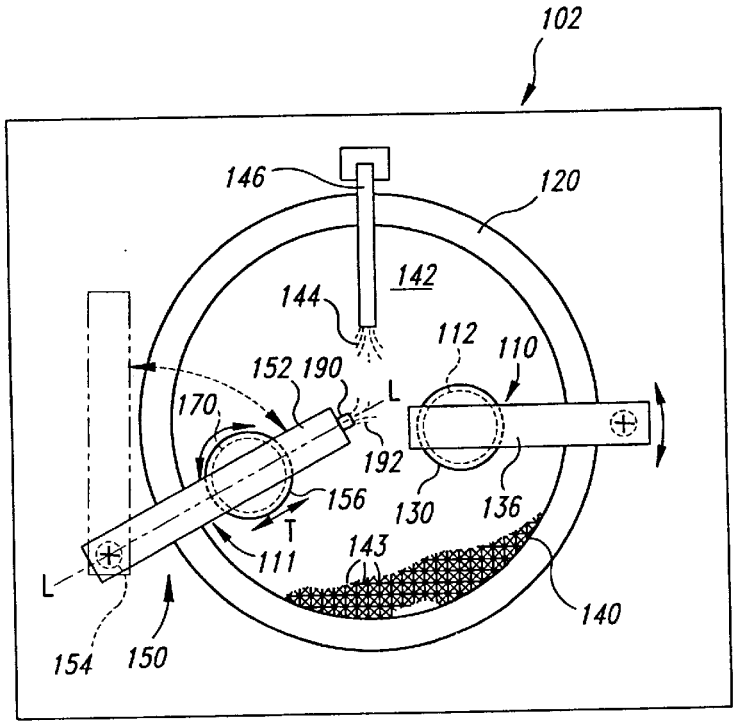
FIG. 2 is a schematic top plan view of an embodiment of a pad refurbishing device in accordance with the invention.
Figure 3:
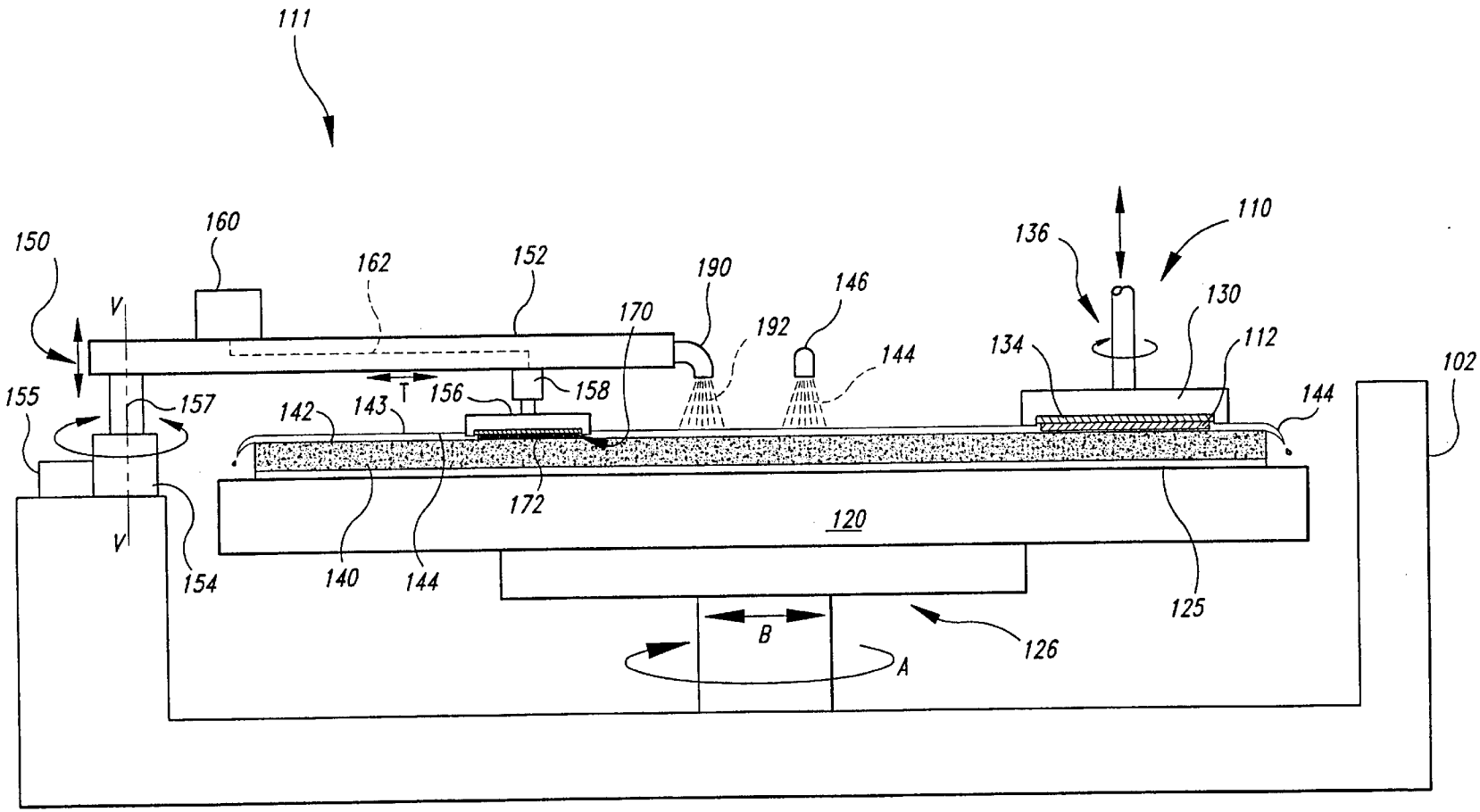
FIG. 3 is a schematic side elevational view of the pad refurbishing device of FIG. 2.

FIGS. 2 and 3 illustrate a chemical-mechanical planarization machine 102 with a wafer planarizing mechanism 110, a pad refurbishing device 111, and a platen 120. As discussed above in FIG. 1, a wafer carrier 130 is attached to an actuator 136 that moves the wafer carrier 130 with respect to a fixed-abrasive polishing pad 140 on the platen 120. Additionally, a solution 144 is deposited onto the planarizing surface 142 of the fixed-abrasive pad 140 by a solution dispenser 146 positioned proximate to the polishing pad 140. A wafer 112 mounted to the wafer carrier 130 is planarized on a planarizing surface 142 of the fixed-abrasive pad 140. A suitable wafer planarizing mechanism 110 and platen 120 are manufactured by IPEC/Westech Systems, Inc., of Phoenix, Ariz.

The pad refurbishing device 111 preferably has a non-abrasive refurbishing element 170 mounted to a refurbishing element carrier 156 of a carriage assembly 150. The refurbishing element 170 has a non-abrasive contact medium 172 (shown only in FIG. 2) that engages the planarizing surface 142 of the fixed-abrasive pad 140 to scrub waste matter from the planarizing surface 142 without abrading or damaging raised features 143 on the fixed-abrasive pad 140. The refurbishing element 170 is preferably a brush, and thus the contact medium 172 is preferably a plurality of resilient, flexible bristles extending downwardly towards the planarizing surface 142 of the polishing pad 140.

The refurbishing element carriage assembly 150 has an arm 152 positionable over the planarizing surface 142 of the fixed-abrasive pad 140, an actuator 154 connected to the arm 152, and the refurbishing element carrier 156 attached to the arm 152. The actuator 154 raises and lowers the arm 152 with respect to the fixed-abrasive pad 140 to engage the refurbishing element 170 with the planarizing surface 142. The actuator 154 is preferably a cylinder that moves a rod 157 upwardly and downwardly with respect to the planarizing surface 142 of the polishing pad 140, and a motor 155 is preferably attached to the actuator 154 for rotating the actuator 154 and the arm 152 about an axis V-V (best shown in FIG. 3). The actuator 154 preferably presses the refurbishing element 170 against the polishing pad 140 with a pressure of between approximately 2 psi and approximately 50 psi, and more preferably between 5 psi and 9 psi.

In a preferred embodiment, a second actuator 160 is operatively coupled to the refurbishing element carrier 156 by a connector 162 to translate the carrier 156 and refurbishing element 170 along the longitudinal axis L-L of the arm 152 (shown by arrow T). The connector 162 (shown in FIG. 2) for translating the carrier 156 may be a long threaded screw drive threadedly engaged with a threaded block 157 and driven by the second actuator 160. In another embodiment, the second actuator 160 may be a cylinder (not shown) mounted along the L-L axis of the arm 152, and the connector 162 may be the cylinder rod (not shown). Also, a separate solution dispenser 190 is preferably attached to the arm 152 for depositing a conditioning solution 192 or other liquid onto the planarizing surface 142 of the fixed-abrasive pad 140. One refurbishing element carriage assembly 150 suitable for use with the invention is manufactured by IPEC/Westech Systems, Inc., of Phoenix, Ariz., and disclosed in U.S. Pat. No. 5,456,627, entitled "CONDITIONER FOR A POLISHING PAD AND METHOD THEREFOR," which is herein incorporated by reference.

Figure 4:
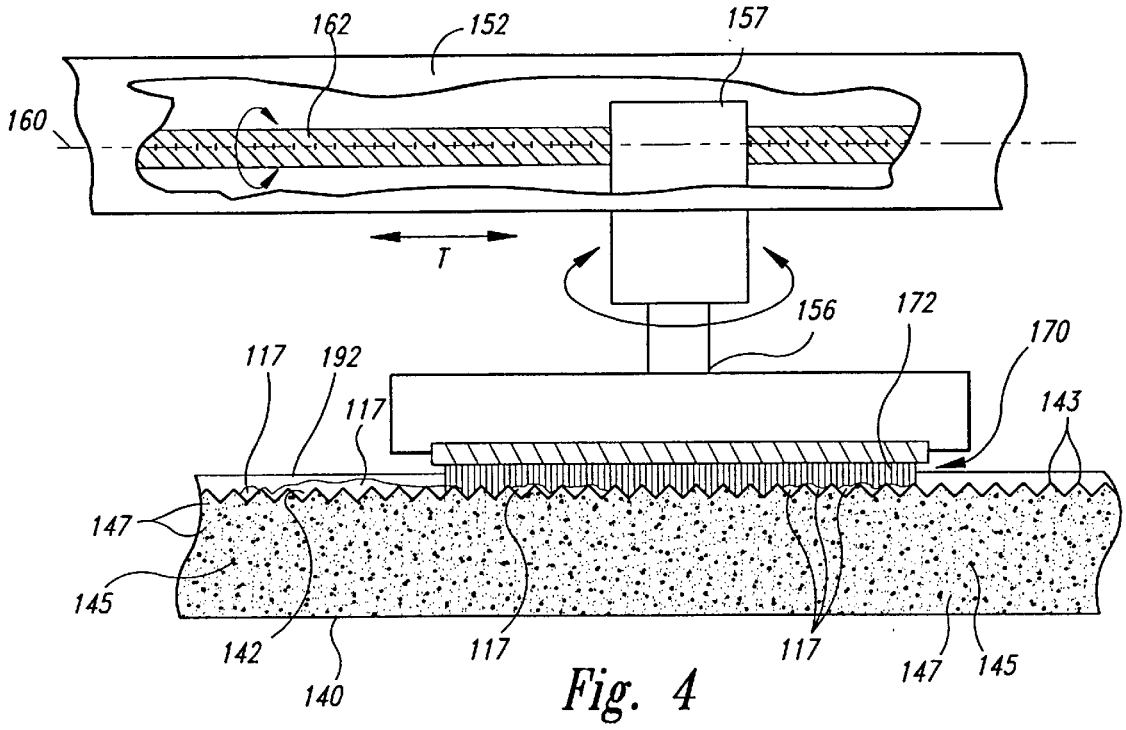
FIG. 4 is a schematic partial cross-sectional view of a non-abrasive refurbishing element conditioning a fixed-abrasive polishing pad in accordance with the invention.

FIG. 4 illustrates a preferred embodiment of the refurbishing element 170 as it conditions the fixed-abrasive pad 140. The refurbishing element carrier 156 presses the refurbishing element 170 against the fixed-abrasive pad 140 and moves the non-abrasive contact medium 172 across the raised features 143 of the fixed-abrasive pad 140. In this embodiment, the refurbishing element 170 is a brush with a non-abrasive contact medium 172 composed of a plurality of bristles.

The bristles of the non-abrasive contact element 172 are preferably made from a resilient, flexible material so that they deflect under the influence of the down force without abrading the fixed-abrasive pad 140 or otherwise damaging the raised features 143. The bristles are preferably long enough to reach the lower points of the planarizing surface 142, but short enough so that they are sufficiently stiff to scrub the waste matter 117. In a preferred embodiment, the refurbishing element 170 is a pad with nylon bristles having a length between 0.1 and 0.5 inches, and the density of the bristles is preferably between 100–2000 bristles/in$^2$. The bristles, however, may be made from other material, have different lengths, and be mounted to a brush with different densities. Other suitable materials from which the bristles may be made include natural fibers; polyvinyl chloride; polyethylene; polypropylene; polystyrene; polyvinyl acetate; acrylics; polyester; ABS polymers; and polyacrylonitrile. Suitable refurbishing elements 170 are manufactured by 3M Corporation of St. Paul, Minn.

Still referring to FIG. 4, the conditioning solution 192 deposited onto the planarizing surface 142 of the polishing pad 140 reacts with the waste matter material 117 so that the non-abrasive refurbishing element 170 removes the waste matter material 117 from the polishing pad without damaging the raised features 143. As a result, the conditioning solution 192 allows a non-abrasive refurbishing element 170 to have a non-abrasive contact medium 172 that is much less mechanically aggressive compared to the diamond-embedded conditioning disks of conventional conditioning devices. Thus, a central aspect of non-abrasive contact mediums 172 in accordance with the invention is that they do not ordinarily abrade or damage the abrasive particles 147 or the suspension media 145 of fixed-abrasive polishing pads under normal down forces of between approximately 2 and approximately 50 psi.

The conditioning solution 192 is also selected to either provide in situ or ex situ conditioning of the fixed-abrasive polishing pad 140. In situ conditioning requires that the conditioning solution 192 be compatible with the planarizing fluid and the material being planarized on the wafer 112 (shown in FIGS. 2 and 3). For in situ conditioning, the conditioning solution preferably has a pH selected to oxidize or otherwise react with the waste matter material without causing an uncontrollable etch to occur on the surface of the wafer. In a preferred embodiment of in situ conditioning, the conditioning solution 192 is preferably the same as the planarizing solution used on the fixed-abrasive polishing pad during CMP of the wafer 112. Therefore, the conditioning solution 192 may be dispensed onto the polishing pad through either the solution dispenser 146 or the solution dispenser 190 depending upon the compatibility between the conditioning solution 192 and the planarizing solution 144.

Specific examples of suitable in situ conditioning solutions are generally categorized by whether the waste matter is polysilicon or a metal. When a layer of polysilicon or doped polysilicon is being planarized, a conditioning solution of ammonium hydroxide ($NH_4OH$) or tetramethyl ammonium hydroxide may be used to remove polysilicon waste matter material from the fixed-abrasive pad. In another example, when a metal layer is being planarized, a conditioning solution of hydrogen peroxide, potassium iodate, ferric nitrate, bromide, and other solutions that have a pH of generally less than 5.0 may be used to remove metal waste matter material.

In the case of ex situ conditioning, the conditioning solution is preferably selected to dissolve the waste matter material without reacting with the polishing pad 140. The range of suitable conditioning solutions 192 is broader for ex situ conditioning than for in situ conditioning because the effect of the conditioning solution 192 on the wafer is not a concern in ex situ conditioning. Therefore, a hydrofluoric acid (HF) solution may be used to condition waste matter accumulations on the fixed-abrasive pad 140. Additionally, solutions of hydrogen peroxide, potassium iodate, ferric nitrate, and bromine that have a pH over 5.0 may be used to remove metal waste matter accumulations from the fixed-abrasive pad 140.

Figure 5A:
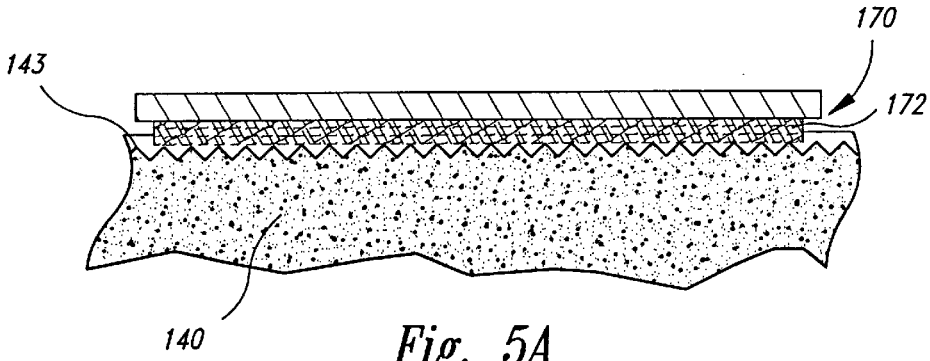
FIG. 5A is a schematic cross-sectional view of another non-abrasive refurbishing element in accordance with the invention.
Figure 5B:
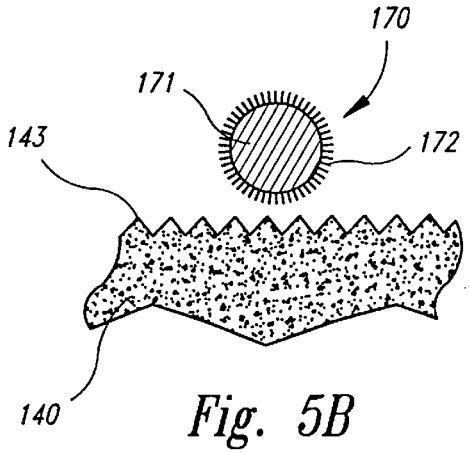
FIG. 5B is a schematic cross-sectional view of another non-abrasive refurbishing element in accordance with the invention.

FIGS. 5A and SB illustrate additional embodiments of non-abrasive refurbishing elements 170 in accordance with the invention. Referring to FIG. 5A, the refurbishing element 170 is a pad with a non-abrasive contact medium 172 composed of randomly oriented fibers that form a flocculant medium. The fibers of the non-abrasive contact medium 172 are preferably made from a resilient, flexible polymeric material such as nylon. Referring to FIG. 5B, the non-abrasive refurbishing element 170 is a roller with a non-abrasive contact medium 172 that is either a plurality of bristles or a pad of randomly oriented fibers. As discussed above, however, the fibers may be made from other suitable materials. In operation, the non-abrasive refurbishing element 170 shown in FIG. 5B rotates in a direction R as the non-abrasive contact medium 172 is pressed against raised features of a fixed-abrasive pad.

One advantage of a preferred embodiment of the pad refurbishing device 111 is that glazed waste matter material may be removed from fixed-abrasive polishing pads without abrading or otherwise damaging raised features on the fixed-abrasive pads. Referring to FIG. 4, it will be appreciated that conventional diamond-embedded abrasive conditioning disks will not only remove the waste matter accumulations 117, but they will also abrade the planarizing surface 142 and damage the raised features 143 on the fixed-abrasive pad 140. In a preferred embodiment of the present invention, however, the conditioning solution 192 reacts with the waste matter material 117 to reduce it to a state in which the non-abrasive contact medium 172 can remove it without abrading or damaging the raised features 143. Therefore, a preferred embodiment of the refurbishing device 111 of the CMP machine 102 effectively refurbishes fixed-abrasive pads to bring them into a desired condition for planarizing subsequent wafers.

Another advantage of the preferred embodiment of the present invention is that both fixed-abrasive polishing pads and conventional polishing pads may be conditioned in situ and in real time while a wafer is planarized. In situ conditioning generally is not performed with conventional diamond-embedded disks because the diamond-embedded disks break relatively large particles from the pad that may scratch the surface of the wafer under typical CMP conditions. The preferred embodiment of the conditioning machine 102 of the present invention, however, is not expected to break particles away from the pad or the waste matter material because the non-abrasive refurbishing element does not abrade the waste matter material or the pad. Therefore, it is expected that both fixed-abrasive polishing pads and conventional polishing pads may be refurbished in situ while a wafer is planarized without scratching the surface of the wafer.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A machine ror planarizing a microelectronic-device substrate assemly, comprising:

a platen mounted to a support structure;

a fixed abrasive polishing pad positioned on the platen;

a movable substrate assembly carrier to which the substrate assembly is mounted, the substrate assembly carrier being positionable over the polishing pad and adapted to engage the substrate assembly with the planarizing surface of the polishing pad, wherein at feast one of the platen and the substrate assembly carrier moves with respect to the other to impart relative motion between the substrate assembly and the polishing pad;

a carriage assembly positioned proximate to the polishing pad, the carriage assembly having an ann positionable over the planarizing surface;

a non-abrasive refurbishing element attached to the ann, the non-abrasive refurbishing clement being a plurality of resilient bristles that are sufficiently stiff to dislodge the residual matter from the planarizing surface of the polishing pad under a desired downforce so that the refurbishing element can remove the interacted material from the polishing pad without abrading the planarizing surface as at least one of the refurbishing element and the polishing pad moves with respect to the other;

a liquid solution dispenser fixedly positioned on the arm and further positionable proximate to the planarizing surface of the polishing pad, the solution dispenser being connected to a supply of conditioning solution that interacts with residual matter on the planarizing surface, the residual matter being from at least one of the substrate assembly, the liquid solution and the polishing pad to form an interacted material on the planarizing surface; and an actuator including a motor operatively attached to the actuator and structured to rotate the actuator and the arm, and a second actuator structured to move the element relative to the dispenser and along the arm to bias the non-abrasive refurbishing element against the planarizing surface of the polishing pad at the desired down force.

2. The planarizing machine of claim 1 wherein the bristles are nylon.

3. The planarizing machine of claim 1 wherein the bristles have a density of between approximately 100 and approximately 2000 bristles per square inch.

4. The planarizing machine of claim 1 wherein the bristles have a length of between approximately 0.1 and 0.5 inches.

5. The planarizing machine of claim 1, wherein the second actuator is further comprised of a screw drive driven by the second actuator and operatively connected to the refurbishing element to move the refurbishing element along the arm.

6. The machine of claim 1 wherein the polishing pad comprise the a fixed-abrasive polishing pad positioned on the platen, the fixed abrasive polishing pad having a body with a planarizing surface and a plurality of abrasive particles fixedly attached to the body at least at the planarizing surface, a portion of the abrasive particles being exposed at the planarizing surface.

7. In planarization of microelectronic-device substrate assemblies, a method for removing accumulations of matter From a planarizing surface of a fixed-abrasive polishing pad comprising:

depositing a conditioning solution from a dispenser fixedly positioned on an arm that is further positionable over the planarizing surface of the fixed-abrasive polishing pad, the conditioning solution reacting with the accumulations of matter to form a reacted matter that may be removed with a first frictional force;

pressing a non-abrasive refurbishing element against the planarizing surface in the presence of the conditioning solution, the non-abrasive refurbishing element being pressed against the planarizing surface with an actuator that includes a motor operatively attached to the actuator and structured to rotate the actuator and the ann, and a second actuator structured to move the element along the aim and relative to the dispenser, the element being pressed against the surface with a force greater than the first frictional force and less than a second frictional force at which the refurbishing element abrades the polishing pad; and moving at least one of the fixed-abrasive pad and the non-abrasive refurbishing element with respect to the other to impart relative motion therebetween, the non-abrasive refurbishing element being a brush having a plurality of resilient bristles that dislodge and remove the reacted matter from the planarizing surface without substantially abrading the planarizing surface of the fixed-abrasive polishing pad.

8. The method of claim 7 wherein depositing a conditioning solution comprises coating at least a portion of the planarizing surface with a solution of ammonium hydroxide.

9. The method of claim 7 wherein depositing a conditioning solution comprises coating at least a portion of the planarizing surface with a solution of tetramethyl ammonium hydroxide.

10. The method of claim 7 wherein depositing a conditioning solution comprises coating at least a portion of the planarizing surface with a solution of potassium iodate.

11. The method of claim 7 wherein depositing a conditioning solution comprises coating at least a portion of the planarizing surface with a solution of ferric nitrate.

12. The method of claim 7 wherein depositing a conditioning solution step comprises coating at least a portion of the planarizing surface with a solution having a pH less than 50.

13. The method of claim 7 wherein depositing a conditioning solution comprises coating at least a portion of the planarizing surface with a solution having a pH greater than 5.0.

14. The method of claim 7 wherein depositing a conditioning solution comprises coating at least a portion of the planarizing surface with a solution having a pH greater than 10.0.

15. The method of claim 7 wherein pressing the refurbishing element against the planarizing surface comprises engaging the bristles with the planarizing surface with a force between approximately 2 and approximately 50 psi.

16. A method for planarizing a microelectronic-device substrate assembly, comprising:

providing a fixed-abrasive polishing pad having a suspension medium, a plurality of abrasive particles fixedly dispersed in the suspension medium, and a planarizing surface with a plurality of exposed abrasive particles;

depositing a liquid solution from a dispenser fixedly positioned on an ant that is further positionable over the planarizing surface onto at least a portion of the planarizing surface of the fixed-abrasive polishing pad, the liquid solution breaking down residual matter on the planarizing surface that came from at least one of the substrate assembly, a planarizing solution and the polishing pad;

engaging the substrate assembly with the planarizing surface;

moving the fixed-abrasive pad with respect to a non-abrasive refurbishing element and the substrate assembly; and pressing the non-abrasive refurbishing element against the planarizing surface in the presence of the conditioning solution with an actuator including a motor operatively attached to the actuator and structured to rotate the actuator and the ann, and a second actuator structured to move the element relative to the dispenser and along the ant, the non-abrasive refurbishing element comprising a brush having a plurality of resilient bristles that are pressed against the planarizing surface with sufficient force to remove the residual matter from the planarizing surface but with insufficient force to substantially alter the exposed abrasive particles at the planarizing surface of the polishing pad.

17. The method of claim 16 wherein depositing a liquid solution comprises coating at least a portion of the planarizing surface with a solution of ammonium hydroxide.

18. The method of claim 16 wherein depositing a liquid solution comprises coating at least a portion of the planarizing surface with a solution of tetramethyl ammonium hydroxide.

19. The method of claim 16 wherein depositing a liquid solution comprises coating at least a portion of the planarizing surface with a solution of potassium iodate.

20. The method of claim 16 wherein depositing a liquid solution comprises coating at least a portion of the planarizing surface with a solution of ferric nitrate.

21. The method of claim 16 wherein depositing a liquid solution comprises coating at least a portion of the planarizing surface with a solution having a pH less than 5.0.

22. The method of claim 16 wherein depositing a liquid solution comprises coating at least a portion of the planarizing surface with a solution having a pH greater than 10.0.

23. The method of claim 16 wherein pressing the refurbishing element against the planarizing surface further comprises forcing the bristles against the planarizing surface with a force between approximately 2 and approximately 50 psi.

24. A method for planarizing a microelectronic-device substrate assembly, comprising:

providing a fixed-abrasive polishing pad having a suspension medium, a plurality of abrasive particles fixedly suspended in the suspension medium, and a planarizing surface with a plurality of exposed abrasive particles;

translating at least one of the fixed-abrasive polishing pad and the substrate assembly with respect to the other to impart relative motion therebetween;

pressing he substrate assembly against the fixed-abrasive polishing pad to remove material from the substrate assembly;

dispensing conditioning solution onto the fixed-abrasive polishing pad from a dispenser fixedly positioned cm an arm that is positionable over the fixed-abrasive polishing pad; and engaging a non-abrasive refurbishing element with the planarizing surface with sufficient force to cause the non-abrasive refurbishing element to remove accumulations of matter from the planarizing surface without substantially altering the exposed abrasive particles at the planarizing surface, the non-abrasive refurbishing element being comprised of a brush having a plurality of resilient bristles, and being engaged with the planarizing surface by an actuator that includes a motor operatively attached to the actuator and structured to rotate the actuator and the arm, and a second actuator structured to move the element relative to the dispenser and along the arm.

25. The method of claim 24, further comprising removing the substrate assembly from the fixed-abrasive polishing pad prior to engaging the non-abrasive refurbishing element with the planarizing surface.

26. The method of claim 24 wherein engaging the non-abrasive refurbishing element with the planarizing surface occurs while the substrate assembly is pressed against the fixed-abrasive polishing pad.

27. In planarization of microelectronic-device substrate assemblies, a method for removing accumulations of matter from a planarizing surface of a fixed abrasive polishing pad comprising:

depositing a conditioning solution onto the planarizing surface of the fixed abrasive pad from a dispenser fixedly positioned on an arm that is positionable over the planarizing surface that reacts with the accumulations of matter to form a reacted matter that may be removed with a first frictional force;

pressing a non-abrasive refurbishing element comprised of a brush that includes a plurality of resilient bristles against the planarizing surface in the presence of the conditioning solution with force greater than the first frictional force and less than a second frictional force at which the refurbishing element abrades the polishing pad; and moving at least one of the polishing pad and the non-abrasive refurbishing element with respect to the other to impart relative motion there between, the non-abrasive refurbishing element dislodging and removing the reacted matter from the planarizing surface without substantially abrading the planarizing surface of the polishing pad, the non-abrasive refurbishing element being moved by an actuator that includes a motor operatively attached to the actuator and structured to rotate the actuator and the arm, and a second actuator structured to move the element relative to the dispenser and along the arm.

28. The method of claim 27 wherein depositing a conditioning solution comprises coating at least a portion of the planarizing surface with a solution of ammonium hydroxide.

29. The method of claim 27 wherein depositing a conditioning solution comprises coating at least a portion of the planarizing surface with a solution of tetramethyl ammonium hydroxide.

30. The method of claim 27 wherein depositing a conditioning solution comprises coating at least a portion of the planarizing surface with a solution of potassium iodate.

31. The method of claim 27 wherein depositing a conditioning solution comprises coating at least a portion of the planarizing surface with the solution of ferric nitrate.

32. The method of claim 27 wherein depositing a conditioning solution step comprises coating at least a portion of the planarizing surface with a solution having a pH less than 5.0.

33. The method of claim 27 wherein depositing a conditioning solution comprises coating at least a portion of the planarizing surface with a solution having a pH greater than 5.0.

34. The method of claim 27 wherein depositing a conditioning solution comprises coating at least a portion of the planarizing surface with a solution having a pH greater than 10.0.

35. The method of claim 27 wherein pressing the refurbishing element against the planarizing surface comprises engaging the bristles with the planarizing surface with a force between approximately 2 and approximately 50 psi.

36. The method of claim 27 wherein the polishing pad comprises a fixed-abrasive polishing pad having a body with a planarizing surface and plurality of abrasive particles fixedly attached to the body at least at the planarizing surface, a portion of the abrasive particles being exposed at the planarizing surface.

* * * * *

UNITED STATES PATENT AND TRADEMARK OFFICE

CERTIFICATE OF CORRECTION

PATENT NO. : 6,769,967 B1
DATED : August 3, 2004
INVENTOR(S) : Scott A. Southwick It is certified that error appears in the above-identified patent and that said Letters Patent is hereby corrected as shown below:

Column 1,
Line 12, reads "U.S. Pat. Ser. No." should read -- U.S. Pat. No. --.

Column 7,
Line 20, reads "machine ror planarizing" should read -- machine for planarizing --.
Line 30, reads "feast one" should read -- least one --.
Line 35, reads "having an ann" should read -- having an arm --.
Line 37, reads "to the ann," should read -- to the arm, --.

Column 8,
Line 8, reads "comprise the a" should read -- comprises a --.
Line 15, reads "From a planarizing" should read -- from a planarizing --.
Line 28, reads "and the ann," should read -- and the arm, --.
Line 30, reads "the aim" should read -- the arm --.
Line 59, reads "50." should read -- 5.0. --.

Column 9,
Line 12, reads "on an ant" should read -- on an arm --.
Line 29, reads " and the ann," should read -- and the arm, --.
Line 31, reads "along the ant," should read -- along the arm, --.

Column 10,
Line 4, reads "pressing he substrate" should read -- pressing the substrate --.
Line 10, reads "positioned cm" should read -- positioned on --.
Line 51, reads "there between," should read -- therebetween, --.

Signed and Sealed this

Eleventh Day of October, 2005

JON W. DUDAS
*Director of the United States Patent and Trademark Office*